US010269277B2

(12) United States Patent
Shim

(10) Patent No.: US 10,269,277 B2
(45) Date of Patent: Apr. 23, 2019

(54) ORGANIC LIGHT EMITTING DISPLAY PANEL, ORGANIC LIGHT EMITTING DISPLAY DEVICE AND THE METHOD FOR DRIVING THE SAME

(71) Applicant: LG DISPLAY CO., LTD., Seoul (KR)

(72) Inventor: Joosung Shim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 41 days.

(21) Appl. No.: 15/686,887

(22) Filed: Aug. 25, 2017

(65) Prior Publication Data

US 2018/0061296 A1 Mar. 1, 2018

(30) Foreign Application Priority Data

Aug. 31, 2016 (KR) ..... 10-2016-0112176

(51) Int. Cl.

| | |
|---|---|
| ***G09G 3/30*** | (2006.01) |
| ***G09G 3/00*** | (2006.01) |
| ***G09G 3/3258*** | (2016.01) |
| ***G09G 3/3266*** | (2016.01) |
| ***G09G 3/3275*** | (2016.01) |
| ***G09G 3/3233*** | (2016.01) |
| *G09G 3/3291* | (2016.01) |

(52) U.S. Cl.

CPC ..... *G09G 3/006* (2013.01); *G09G 3/3233* (2013.01); *G09G 3/3258* (2013.01); *G09G 3/3266* (2013.01); *G09G 3/3275* (2013.01); *G09G 3/3291* (2013.01); *G09G 2300/0452* (2013.01); *G09G 2300/0819* (2013.01); *G09G 2300/0842* (2013.01); *G09G 2310/08* (2013.01); *G09G 2320/0295* (2013.01); *G09G 2320/045* (2013.01); *G09G 2330/02* (2013.01); *G09G 2330/12* (2013.01)

(58) Field of Classification Search

CPC ..... G06F 3/041; G06F 3/045; G06K 11/06; G08C 21/00; G09G 3/30

See application file for complete search history.

(56) References Cited

U.S. PATENT DOCUMENTS

2011/0191042 A1* 8/2011 Chaji ..... G09G 3/32 702/64
2014/0252988 A1* 9/2014 Azizi ..... H05B 33/0848 315/307

(Continued)

*Primary Examiner* — Pegeman Karimi
(74) *Attorney, Agent, or Firm* — Birch, Stewart, Kolasch & Birch, LLP

(57) ABSTRACT

An organic light emitting display device can include data lines; scan lines; subpixels; a data driver; and a scan driver, in which each of the subpixels includes: an organic light emitting diode; a driving transistor connected to the organic light emitting diode; a first transistor controlled by a first scan signal applied to a first gate node and connected between the driving transistor and a data line; a second transistor controlled by a second scan signal applied to a second gate node and connected between the driving transistor and a reference voltage line; a third transistor controlled by a data voltage applied to a third gate node and connected between the second gate node of the second transistor and the second scan line; and a storage capacitor connected between the first node and the second node of the driving transistor.

19 Claims, 10 Drawing Sheets

(56) References Cited

U.S. PATENT DOCUMENTS

| | | | | |
|---|---|---|---|---|
| 2015/0154899 | A1* | 6/2015 | Chang | G09G 3/3233 345/76 |
| 2015/0187268 | A1* | 7/2015 | Tani | G09G 3/3233 345/77 |
| 2016/0125811 | A1* | 5/2016 | Park | G09G 3/3258 345/694 |
| 2017/0039953 | A1* | 2/2017 | Lee | G09G 3/3233 |

* cited by examiner

ORGANIC LIGHT EMITTING DISPLAY PANEL, ORGANIC LIGHT EMITTING DISPLAY DEVICE AND THE METHOD FOR DRIVING THE SAME

CROSS-REFERENCE TO RELATED APPLICATIONS

This application claims priority from Korean Patent Application No. 10-2016-0112176, filed on Aug. 31, 2016, which is hereby incorporated by reference for all purposes as if fully set forth herein.

BACKGROUND OF THE INVENTION

Field of the Invention

The present invention relates to an organic light emitting display panel, an organic light emitting display device, and a method for driving the same.

Description of the Related Art

An organic light emitting display device which has recently attracted a lot of attention as a display device uses a self-emitting organic light emitting diode OLED and thus has the advantages of a high response speed and increased luminous efficiency, brightness and a wider viewing angle.

In the organic light emitting display device, subpixels including OLEDs are disposed in a matrix form and the brightness of subpixels selected in response to a scan signal is controlled according to a gray scale of data.

In addition, an OLED includes an anode electrode and a cathode electrode, and the anode electrode and the cathode electrode may become short-circuited by foreign material produced during a manufacturing process, moisture penetration or shock generated after shipment.

Such a short circuit of the OLED may degrade the image quality or may cause a panel burning in severe instances.

However, an organic light emitting display panel cannot accurately detect a short circuit of the OLED due to structural characteristics of a subpixel.

SUMMARY OF THE INVENTION

An aspect of the present invention provides an organic light emitting display panel having a subpixel structure which can detect a short circuit between an anode electrode and a cathode electrode of an organic light emitting diode, an organic light emitting display device, and a method for driving the same.

Another aspect of the present invention provides an organic light emitting display panel having a subpixel structure in which two or more subpixels share a single sensing line, yet can accurately distinguish and detect a short circuit of an organic light emitting diode in each subpixel unit, an organic light emitting display device, and a method for driving the same.

According to an aspect of the present invention, there is provided an organic light emitting display panel in which a plurality of data lines and a plurality of scan lines are disposed and a plurality of subpixels defined by the plurality of data lines and the plurality of scan lines is disposed, a data driver that drives the plurality of data lines, and a scan driver that drives the plurality of scan lines.

In such an organic light emitting display device, each subpixel can include an organic light emitting diode including a first electrode, an organic emission layer, and a second electrode, a driving transistor including a first node corresponding to a gate node, a second node electrically connected to the first electrode of the organic light emitting diode, and a third node to be applied with a driving voltage, a first transistor controlled by a first scan signal applied to a gate node and electrically connected between the first node of the driving transistor and a data line, a second transistor controlled by a second scan signal applied to a gate node and electrically connected between the second node of the driving transistor and a reference voltage line, a third transistor controlled by a data voltage applied to a gate node and electrically connected between a gate node of the second transistor and a second scan line configured to supply the second scan signal, and a storage capacitor electrically connected between the first node and the second node of the driving transistor.

According to another aspect of the present invention, an organic light emitting display panel can include a plurality of data lines, a plurality of scan lines, and a plurality of subpixels defined by the plurality of data lines and the plurality of scan lines.

In the organic light emitting display panel, each subpixel can include an organic light emitting diode including a first electrode, an organic emission layer, and a second electrode, a driving transistor including a first node corresponding to a gate node, a second node electrically connected to the first electrode of the organic light emitting diode, and a third node to be applied with a driving voltage, a first transistor controlled by a first scan signal applied to a gate node and electrically connected between the first node of the driving transistor and a data line, a second transistor controlled by a second scan signal applied to a gate node and electrically connected between the second node of the driving transistor and a reference voltage line, a third transistor controlled by a data voltage applied to a gate node and electrically connected between a gate node of the second transistor and a second scan line configured to supply the second scan signal, and a storage capacitor electrically connected between the first node and the second node of the driving transistor.

According to yet another aspect of the present invention, a method for driving an organic light emitting display device including an organic light emitting display panel in which a plurality of data lines and a plurality of scan lines are disposed and a plurality of subpixels defined by the plurality of data lines and the plurality of scan lines is disposed, and an organic light emitting diode, a driving transistor that drives the organic light emitting diode, and a first transistor electrically connected between a gate node of the driving transistor and a data line are disposed in each subpixel.

The method can include initializing a reference voltage line to a reference voltage for detection in a state where a second transistor connected between a first electrode of the organic light emitting diode and the reference voltage line is turned off, turning on the second transistor, connecting a sensing unit to the reference voltage line when a predetermined time passes after the second transistor is turned on, and sensing a voltage of the reference voltage line by the sensing unit.

The second transistor can be turned on or turned off by a data voltage on the data line electrically connected to a drain node or a source node of the first transistor.

According to the present exemplary embodiments described above, it is possible to provide an organic light emitting display panel having a subpixel structure which can detect a short circuit between an anode electrode and a cathode electrode of an organic light emitting diode, an organic light emitting display device, and a method for driving the same.

Further, according to embodiments, it is possible to provide an organic light emitting display panel having a subpixel structure in which two or more subpixels share a single sensing line and which can accurately distinguish and detect a short circuit of an organic light emitting diode in each subpixel unit, an organic light emitting display device, and a method for driving the same.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
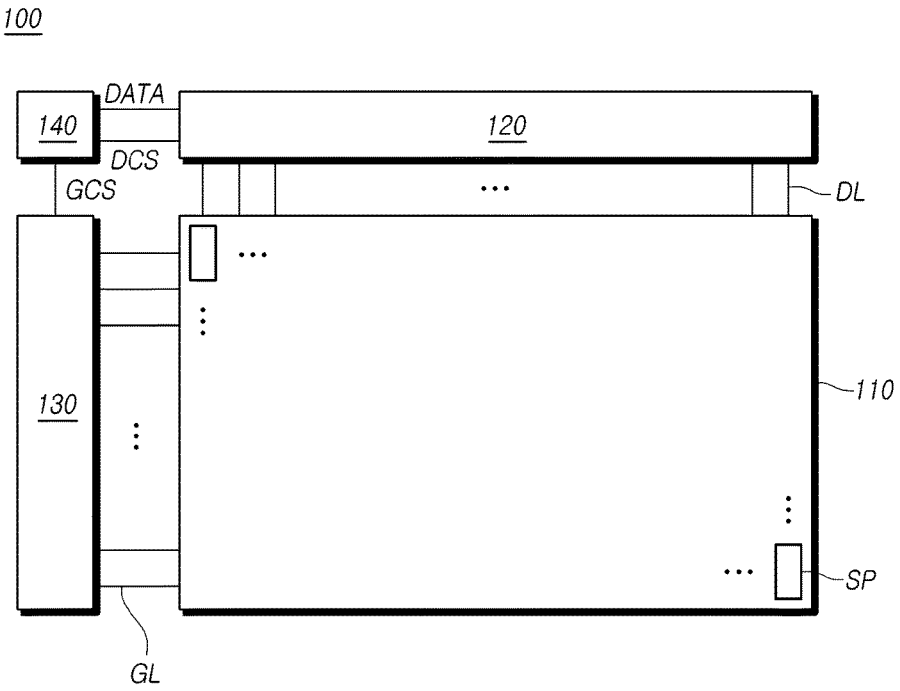
FIG. 1 is a schematic system configuration view of an organic light emitting display device according to an embodiment of the invention.

Hereinafter, some embodiments of the present invention will be described in detail with reference to the accompanying drawings. When reference numerals refer to components of each drawing, although the same components are illustrated in different drawings, the same components are referred to by the same reference numerals as possible. Further, if it is considered that description of related known configuration or function may cloud the gist of the present invention, the description thereof will be omitted.

Further, in describing components of the present invention, terms such as first, second, A, B, (a), (b), etc. can be used. These terms are used only to differentiate the components from other components. Therefore, the nature, order, sequence, or number of the corresponding components is not limited by these terms. It is to be understood that when one element is referred to as being "connected to" or "coupled to" another element, it may be directly connected to or directly coupled to another element, connected to or coupled to another element, having still another element "intervening" therebetween, or "connected to" or "coupled to" another element via still another element.

FIG. 1 is a schematic system configuration view of an organic light emitting display device 100 according to the present exemplary embodiments.

Referring to FIG. 1, the organic light emitting display device 100 according to embodiments includes an organic light emitting display panel 110 in which a plurality of data lines DL and a plurality of scan lines GL are disposed and a plurality of subpixels SP defined by the plurality of data lines DL and the plurality of scan lines GL is disposed, a data driver 120 that drives the plurality of data lines DL, a scan driver 130 that drives the plurality of scan lines GL, and a panel controller 140 that controls the data driver 120 and the scan driver 130.

The panel controller 140 supplies various control signals to the data driver 120 and the scan driver 130 to control the data driver 120 and the scan driver 130.

The panel controller 140 starts scanning according to a timing realized in each frame, converts image data input from the outside into a data signal format used in the data driver 120, outputs the converted image data, and controls data driving at an appropriate time according to the scanning.

The panel controller 140 can be a timing controller or a control device that includes the timing controller and further performs other control functions.

The panel controller 140 can be implemented as a component separate from the data driver 120 or can be implemented as an integrated circuit together with the data driver 120.

The data driver 120 supplies a data voltage to the plurality of data lines DL to drive the plurality of data lines DL. Herein, the data driver 120 is also referred to as a "source driver."

The data driver 120 can include at least one source driver integrated circuit SDIC to drive the plurality of data lines DL.

Each source driver integrated circuit SDIC can include a shift register, a latch circuit, a digital to analog converter DAC, an output buffer, etc.

Each source driver integrated circuit SDIC can further include an analog to digital converter ADC if necessary.

The scan driver 130 sequentially supplies a scan signal to the plurality of scan lines GL to sequentially drive the plurality of scan lines GL. Herein, the scan driver 130 is also referred to as a "gate driver."

The scan driver 130 can include at least one scan driver integrated circuit GDIC.

Each scan driver integrated circuit GDIC can include a shift register, a level shifter, etc.

The scan driver 130 sequentially supplies a scan signal of an on voltage or an off voltage to the plurality of scan lines GL according to the control of the panel controller 140.

When a specific scan line is scanned by the scan driver 130, the data driver 120 converts image data received from the panel controller 140 into a data voltage of an analog form and supplies the data voltage to the plurality of data lines DL.

The data driver 120 can be positioned on only one side (e.g., upper side or lower side) of the organic light emitting display panel 110 as illustrated in FIG. 1, or can be positioned on both sides (e.g., upper side and lower side) of the organic light emitting display panel 110 if necessary, depending on a driving method, a panel design method, etc.

The scan driver 130 can be positioned on only one side (e.g., left side or right side) of the organic light emitting display panel 110 as illustrated in FIG. 1, or can be positioned on both sides (e.g., left side and right side) of the organic light emitting display panel 110 if necessary, depending on a driving method, a panel design method, etc.

The panel controller 140 receives input image data together with various timing signals including a vertical synchronization signal Vsync, a horizontal synchronization signal Hsync, an input data enable (DE) signal, a clock signal CLK, etc. from the outside.

The panel controller 140 receives timing signals, such as a vertical synchronization signal Vsync, a horizontal synchronization signal Hsync, an input (DE) signal, a clock signal, etc., generates various control signals, and outputs the control signals to the data driver 120 and the scan driver 130 in order to control the data driver 120 and the scan driver 130.

For example, the panel controller 140 outputs various gate control signals GCS including a gate start pulse GSP, a gate shift clock GSC, a gate output enable (GOE) signal, etc. in order to control the scan driver 130.

Herein, the gate start pulse GSP controls an operation start timing of the one or more scan driver integrated circuits constituting the scan driver 130. The gate shift clock GSC is a clock signal commonly input to the one or more scan driver integrated circuits, and controls a shift timing of a scan signal (gate pulse). The gate output enable (GOE) signal designates timing information of the one or more scan driver integrated circuits.

Further, the panel controller 140 outputs various data control signals DCS including a source start pulse SSP, a source sampling clock SSC, a source output enable (SOE) signal, etc. in order to control the data driver 120.

Herein, the source start pulse SSP controls a data sampling start timing of the one or more source driver integrated circuits constituting the data driver 120. The source sampling clock SSC is a clock signal for controlling a data sampling timing in each source driver integrated circuit. The source output enable (SOE) signal controls an output timing of the data driver 120.

In addition, each source driver integrated circuit SDIC included in the data driver 120 can be connected to a bonding pad of the organic light emitting display panel 110 through a Tape Automated Bonding (TAB) method or a Chip On Glass (COG) method or may be directly disposed on the organic light emitting display panel 110, or can be integrated and disposed in the organic light emitting display panel 110 if necessary.

Alternatively, each source driver integrated circuit SDIC can be implemented in a Chip On Film (COF) type in which the source driver integrated circuit SDIC is mounted on a film connected to the organic light emitting display panel 110.

Each scan driver integrated circuit GDIC included in the scan driver 130 can be connected to a bonding pad of the organic light emitting display panel 110 through a Tape Automated Bonding (TAB) method or a Chip On Glass (COG) method, or implemented in a Gate In Panel (GIP) type and directly disposed in the organic light emitting display panel 110, or integrated and disposed in the organic light emitting display panel 110 if necessary.

Alternatively, each scan driver integrated circuit GDIC can be implemented in a Chip On Film (COF) type in which the scan driver integrated circuit GDIC is mounted on a film connected to the organic light emitting display panel 110.

The organic light emitting display device 100 according to embodiments can include at least one source printed circuit board SPCB required for connection to at least one source driver integrated circuit SDIC in a circuit manner and a control printed circuit board CPCB for mounting control components and various electrical devices.

At least one source driver integrated circuit SDIC can be directly mounted on the at least one source printed circuit board SPCB, or a film on which at least one source driver integrated circuit SDIC is mounted can be connected to the at least one source printed circuit board SPCB.

On the control printed circuit board CPCB, the controller 140 configured to control the operations of the data driver 120 and the scan driver 130 and a power controller configured to supply various voltages or currents to the organic light emitting display panel 110, the data driver 120, and the scan driver 130 or control various voltages or currents to be supplied thereto can be mounted on the CPCB.

The at least one source printed circuit board SPCB and the control printed circuit board CPCB can be connected through at least one connection medium in a circuit manner.

Herein, the connection medium can be a flexible printed circuit FPC, a flexible flat cable FFC, or the like.

The at least one source printed circuit board SPCB and the control printed circuit board CPCB can be combined into a single printed circuit board.

Further, the controller 140 can be combined with the source driver integrated circuit SDIC.

Each sub pixel SP disposed in the organic light emitting display panel 110 according to embodiments can include an organic light emitting diode OLED as a self-emitting element and a driving transistor configured to drive the OLED.

The kind and the number of circuit elements constituting each subpixel SP can be determined in various ways depending on a provided function and a design method.

Hereinafter, a structure of each subpixel SP disposed in the organic light emitting display panel 110 according to embodiments will be illustrated with reference to FIG. 2 and FIG. 3.

Figure 2:
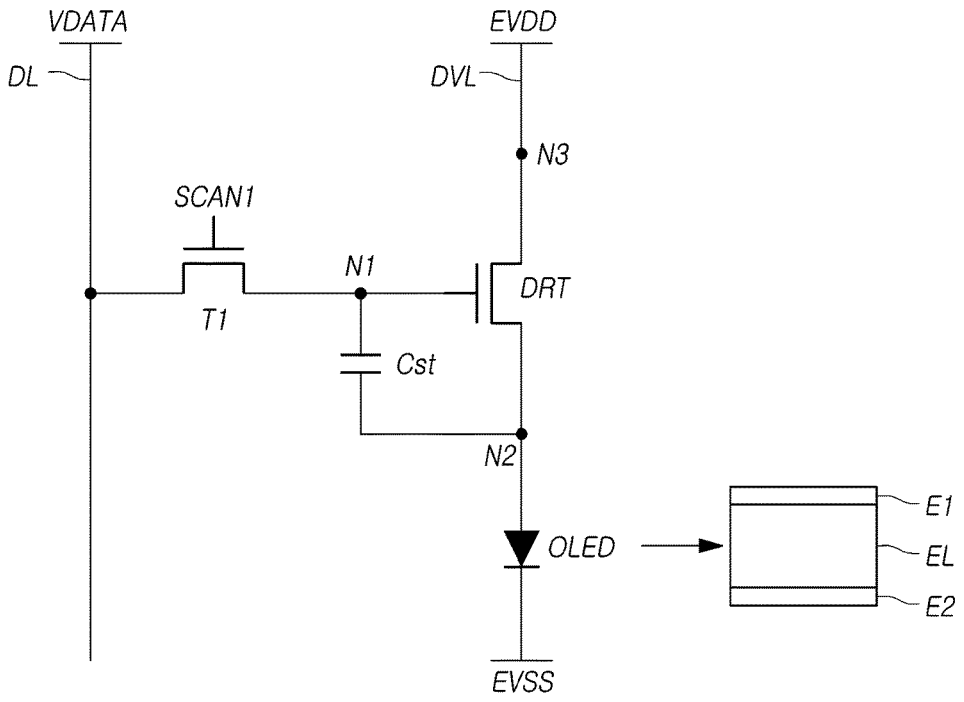
FIG. 2 is a diagram of a subpixel structure of the organic light emitting display device according to an embodiment of the invention.

FIG. 2 is an exemplary diagram of a subpixel structure of the organic light emitting display device 100 according to the present exemplary embodiments.

Referring to FIG. 2, each subpixel SP in the organic light emitting display device 100 according to embodiments can include an organic light emitting diode OLED, a driving transistor DRT that drives the organic light emitting diode OLED, a first transistor T1 configured to transfer a data voltage to a first node N1 corresponding to a gate node of the driving transistor DRT, and a storage capacitor Cst that maintains a data voltage corresponding to an image signal voltage or a voltage corresponding thereto for a single frame.

The organic light emitting diode OLED can include a first electrode E1 (e.g., anode electrode or cathode electrode), an organic emission layer EL, and a second electrode E2 (e.g., cathode electrode or anode electrode).

The second electrode E2 of the organic light emitting diode OLED can be applied with a ground voltage EVSS.

The driving transistor DRT supplies a driving current to the organic light emitting diode OLED to drive the organic light emitting diode OLED.

The driving transistor DRT includes the first node N1, a second node N2, and a third node N3.

The first node N1 of the driving transistor DRT corresponds to a gate node and can be electrically connected to a source node or a drain node of the first transistor T1.

The second node N2 of the driving transistor DRT can be electrically connected to the first electrode E1 of the organic light emitting diode OLED and can be a source node or a drain node.

The third node N3 of the driving transistor DRT is a node to be applied with a driving voltage EVDD and can be electrically connected to a driving voltage line DVL that supplies the driving voltage EVDD and can be a drain node or a source node.

The first transistor T1 is electrically connected between a data line DL and the first node N1 of the driving transistor DRT and can be controlled by a first scan signal SCAN1 applied to a gate node through a scan line.

The first transistor T1 can be turned on by the first scan signal SCAN1 and then can transfer a data voltage VDATA supplied through the data line DL to the first node N1 of the driving transistor DRT.

The storage capacitor Cst can be electrically connected between the first node N1 and the second node N2 of the driving transistor DRT.

Figure 3:
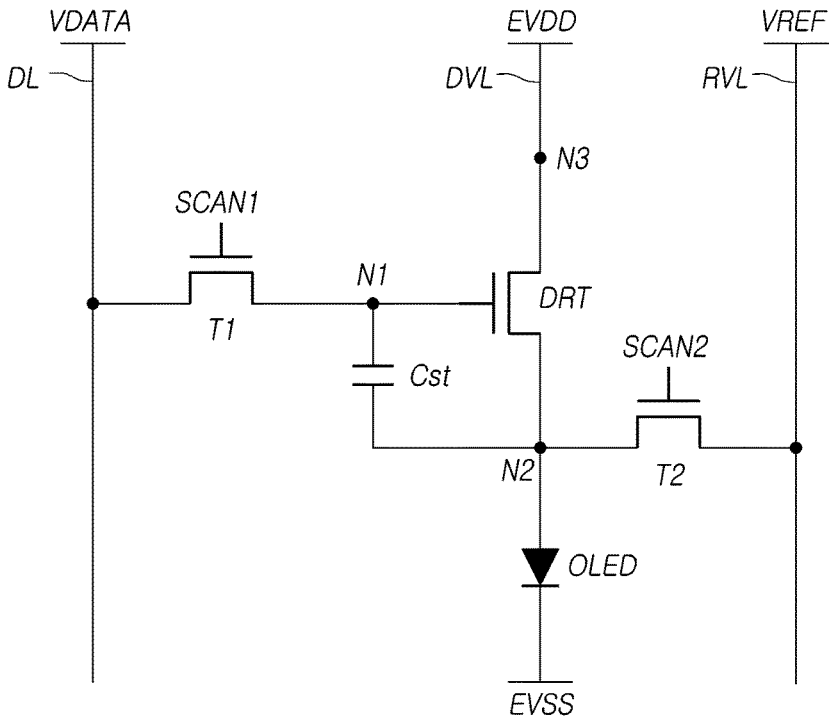
FIG. 3 is another diagram of a subpixel structure of the organic light emitting display device according to an embodiment of the invention.

FIG. 3 is another example diagram of a subpixel structure of the organic light emitting display device 100 according to embodiments.

Referring to FIG. 3, each subpixel SP disposed in the organic light emitting display panel 110 according to embodiments can further include, for example, a second transistor T2 in addition to the organic light emitting diode OLED, the driving transistor DRT, the first transistor T1 and the storage capacitor Cst.

Referring to FIG. 3, the second transistor T2 can be electrically connected between the second node N2 of the driving transistor DRT and a reference voltage line RVL that supplies a reference voltage VREF and can be controlled by a second scan signal SCAN2 applied to a gate node.

Since the subpixel SP further includes the above-described second transistor T2, it is possible to effectively control a voltage state of the second node N2 of the driving transistor DRT in the subpixel SP.

The second transistor T2 can be turned on by the second scan signal SCAN2 and then can apply the reference voltage VREF supplied through the reference voltage line RVL to the second node N2 of the driving transistor DRT.

Further, the second transistor T2 can be used as one of the voltage sensing paths for the second node N2 of the driving transistor DRT.

In addition, the first scan signal SCAN1 and the second scan signal SCAN2 can be separate gate signals. In this instance, the first scan signal SCAN1 and the second scan signal SCAN2 can be applied to the gate node of the first transistor T1 and the gate node of the second transistor T2, respectively, through different scan lines.

In some cases, the first scan signal SCAN1 and the second scan signal SCAN2 can be the same gate signal. In this instance, the first scan signal SCAN1 and the second scan signal SCAN2 can be applied in common to the gate node of the first transistor T1 and the gate node of the second transistor T2 through the same scan line.

Referring to FIG. 2 and FIG. 3, each of the driving transistor DRT, the first transistor T1, and the second transistor T2 may also be implemented as an n-type or p-type transistor.

Referring to FIG. 2 and FIG. 3, the storage capacitor Cst is not a parasitic capacitor (e.g., Cgs, Cgd) which is an internal capacitor present between the first node N1 and the second node N2 of the driving transistor DRT, but is an external capacitor intentionally designed outside the driving transistor DRT.

In addition, the transistors such as the driving transistor DRT and the circuit elements such as the organic light emitting diode OLED in each subpixel SP disposed in the organic light emitting display panel 110 may undergo degradation with the lapse of driving time.

During the degradation, unique characteristics of the circuit elements in each subpixel may be changed.

The characteristics of the circuit elements can include characteristics (e.g., threshold voltage and mobility) of the transistors such as the driving transistor DRT. The characteristics of the circuit elements can also include characteristics (e.g., threshold voltage) of the organic light emitting diode OLED. In the following, the characteristics of the circuit elements will also be described as subpixel characteristics.

Also, each subpixel has a different driving time or different characteristics of circuit elements therein. Thus, each circuit element may have a different degree of change in characteristics with time.

As such, variations of the characteristics of the transistor and/or the organic light emitting diode OLED in the organic light emitting display panel 110 may cause a brightness variation of the organic light emitting display panel 110 and may thus cause great degradation of image quality.

Therefore, the organic light emitting display device 100 according to the present exemplary embodiments can have a compensation function for sensing and compensating the variations of the characteristics of the circuit elements such as the transistor, the organic light emitting diode OLED, etc. and a compensation circuit for the compensation function.

Figure 4:
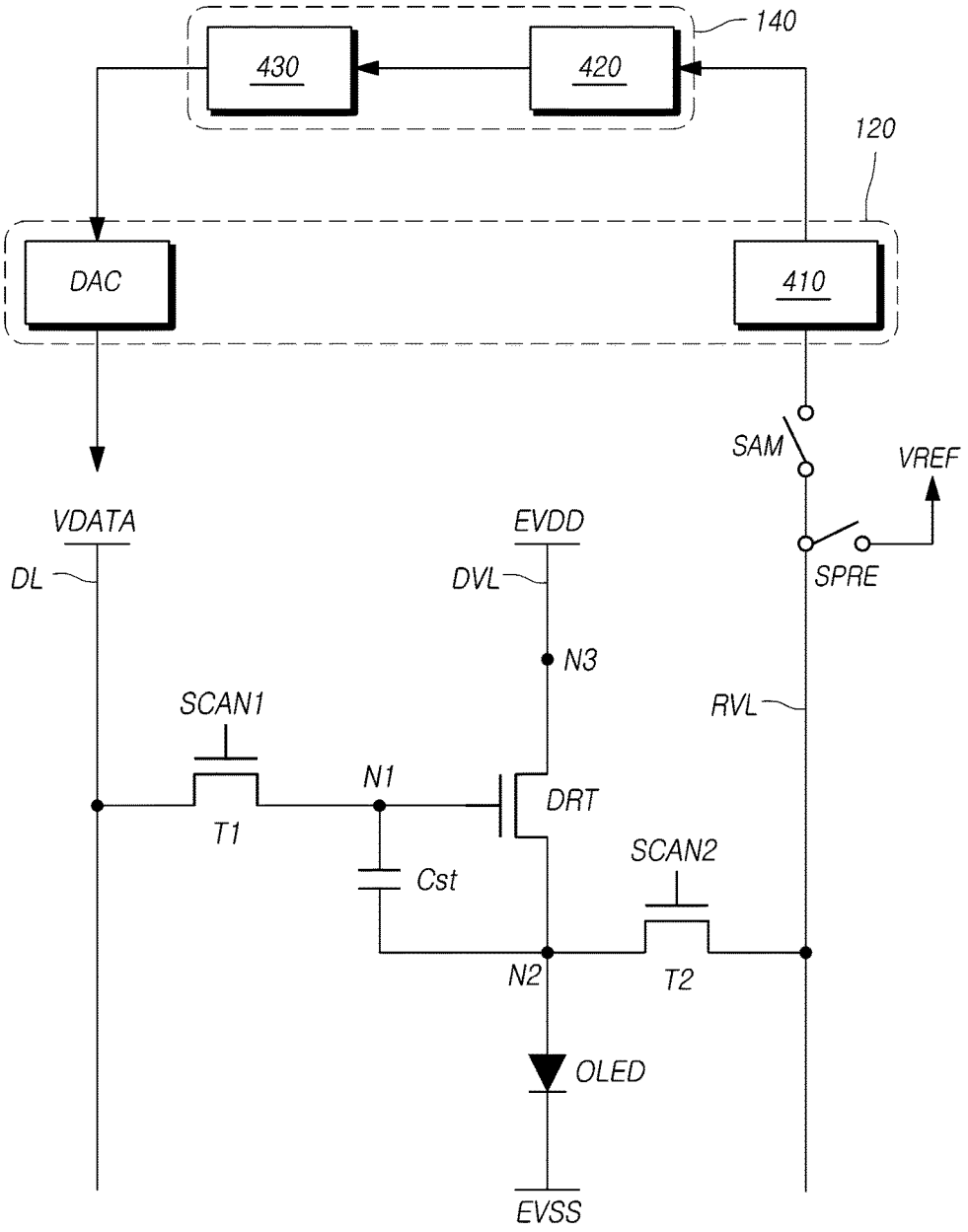
FIG. 4 is an exemplary diagram of a compensation circuit of the organic light emitting display device according to an embodiment of the invention.

FIG. 4 is an exemplary diagram of a compensation circuit of the organic light emitting display device 100 according to embodiments.

Referring to FIG. 4, the organic light emitting display device 100 according to embodiments can include a sensing unit 410 that generates sensing data via voltage sensing and outputs the sensing data to identify characteristics of a subpixel, a memory 420 that stores the sensing data, and a compensation unit 430 that identifies the characteristics of the subpixel using the sensing data and thus performs a compensation process for compensating the characteristics of the subpixel.

For example, the sensing unit 410 can include at least one analog to digital converter ADC.

Each analog to digital converter ADC can be included in each source driver integrated circuit SDIC included inside the data driver 120, or can be included outside the source driver integrated circuit SDIC in some instances.

The compensation unit 430 can be included inside the controller 140, or can be included outside the controller 140 in some instances.

The sensing data output from the sensing unit 410 can be composed of, for example, a low-voltage differential signaling (LVDS) data format.

Referring to FIG. 4, the organic light emitting display device 100 according to embodiments can include an initialization switch SPRE that controls whether or not to apply the reference voltage VREF to the reference voltage line RVL and a sampling switch SAM that controls whether or not to connect the reference voltage line RVL with the sensing unit 410.

The initialization switch SPRE is a switch for controlling a voltage application state of the second node N2 of the driving transistor DRT in the subpixel SP to be in a voltage state that reflects desired characteristics of the circuit elements.

When the initialization switch SPRE is turned on, the reference voltage VREF can be supplied to the reference voltage line RVL and then applied to the second node N2 of the driving transistor DRT through the turned-on second transistor T2.

The sampling switch SAM can be turned on to electrically connect the reference voltage line RVL to the sensing unit 410.

The on-off timing of the sampling switch SAM is controlled in order for the sampling switch SAM to be turned on when the second node N2 of the driving transistor DRT in the subpixel SP is in a voltage state that reflects desired characteristics of the circuit elements.

When the sampling switch SAM is turned on, the sensing unit 410 can sense a voltage of the reference voltage line RVL connected thereto.

When the sensing unit 410 senses a voltage of the reference voltage line RVL, if the second transistor T2 is turned on, the voltage sensed by the sensing unit 410 can correspond to a voltage of the second node N2 of the driving transistor DRT as long as a resistance component of the driving transistor DRT can be ignored.

The voltage sensed by the sensing unit 410 can be a voltage of the reference voltage line RVL, e.g., a voltage of the second node N2 of the driving transistor DRT.

If a line capacitor is present on the reference voltage line RVL, the voltage sensed by the sensing unit 410 can be a voltage charged in the line capacitor on the reference voltage line RVL.

For example, the voltage sensed by the sensing unit 410 can be a voltage value (VDATA-Vth or VDATA-ΔVth: herein, VDATA is a data voltage for sensing driving) including a threshold voltage Vth or a threshold voltage difference ΔVth of the driving transistor DRT, or can be a voltage value for sensing the mobility of the driving transistor DRT.

For example, a single reference voltage line RVL which functions to supply the reference voltage VREF to each subpixel SP and functions as a sensing line for sensing characteristics of each subpixel SP can be disposed in every subpixel column.

Alternatively, a single reference voltage line RVL can be disposed in every two or more subpixel columns.

Figure 5:
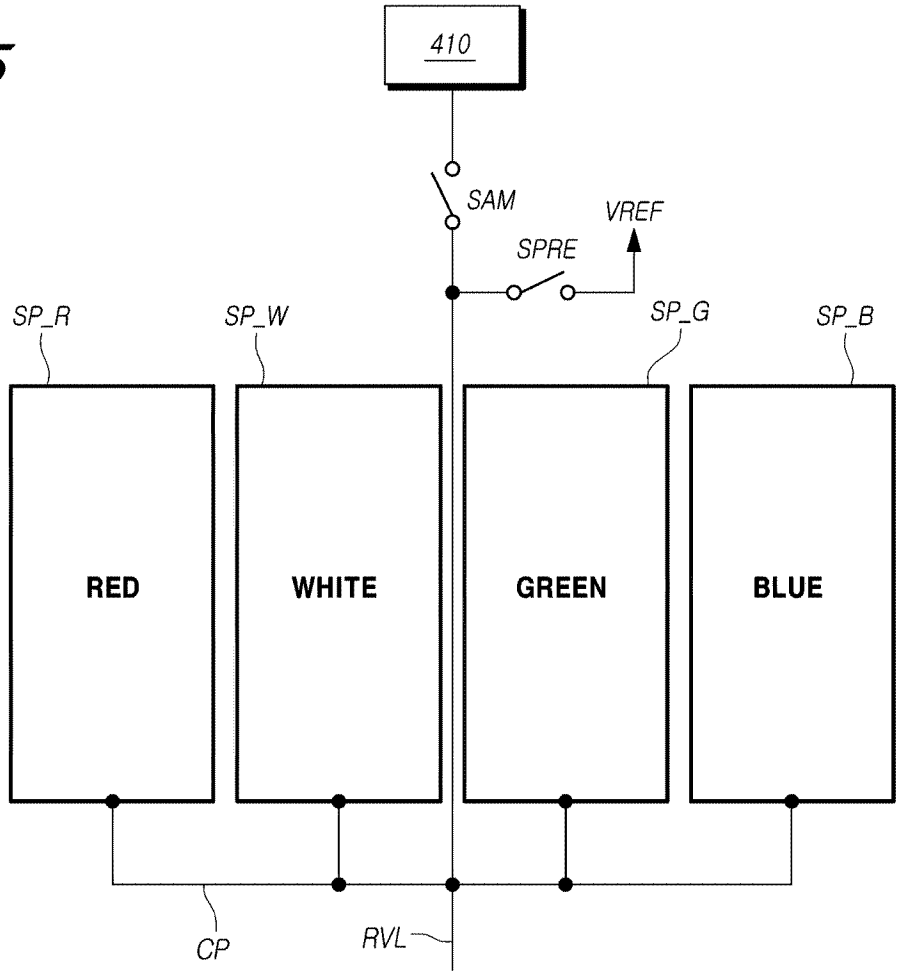
FIG. 5 is a diagram illustrating a sensing sharing structure in an organic light emitting display panel according to an embodiment of the invention.

For example, if a pixel includes four subpixels (a red subpixel, a white subpixel, a green subpixel, and a blue subpixel), a single reference voltage line RVL can be disposed in every pixel column including four subpixel columns (a red subpixel column, a white subpixel column, a green subpixel column, and a blue subpixel column) as illustrated in FIG. 5.

FIG. 5 is a diagram illustrating a sensing sharing structure in the organic light emitting display panel 110 according to embodiments.

Referring to FIG. 5, four subpixels SP_R, SP_W, SP_G, and SP_B are connected in common to a single reference voltage line RVL through a connection pattern CP.

That is, the four subpixels SP_R, SP_W, SP_G, and SP_B share the single reference voltage line RVL.

If the initialization switch SPRE is turned on, the four subpixels SP_R, SP_W, SP_G, and SP_B are supplied with the reference voltage VREF at the same time.

If the sampling switch SAM is turned on, all of the four subpixels SP_R, SP_W, SP_G, and SP_B can be electrically connected to the sensing unit 410.

Therefore, at a point in time, a sensing driving operation needs to be performed to only one of the four subpixels SP_R, SP_W, SP_G, and SP_B.

Otherwise, a voltage of the reference voltage line RVL is shown as a mixture of characteristics of two or more subpixels. Thus, characteristics of each subpixel cannot be sensed accurately.

In addition, the first electrode E1 and the second electrode E2 of each subpixel may be short-circuited by a foreign material produced during a process or moisture and shock generated after shipment.

Such a phenomenon is referred to as an organic light emitting diode short circuit.

If an organic light emitting diode short circuit occurs, a corresponding subpixel cannot normally emit a light, which may cause great degradation of image quality.

Therefore, a method of detecting an organic light emitting diode short circuit is needed.

In this regard, according to the present exemplary embodiments, an organic light emitting diode short circuit can be detected by turning on the second transistor T2 and then measuring a voltage of the first node N1 of the driving transistor DRT electrically connected to the first electrode E1 of the organic light emitting diode OLED.

However, if the organic light emitting diode short circuit is detected by this method, an organic light emitting diode short circuit can also be falsely detected from a subpixel in which an organic light emitting diode OLED is actually not short-circuited, due to the shared sensing sharing structure illustrated in FIG. 5.

Therefore, hereinafter, a method of detecting whether or not an organic light emitting diode is short-circuited in each subpixel unit and a circuit therefor will be described.

Figure 6:
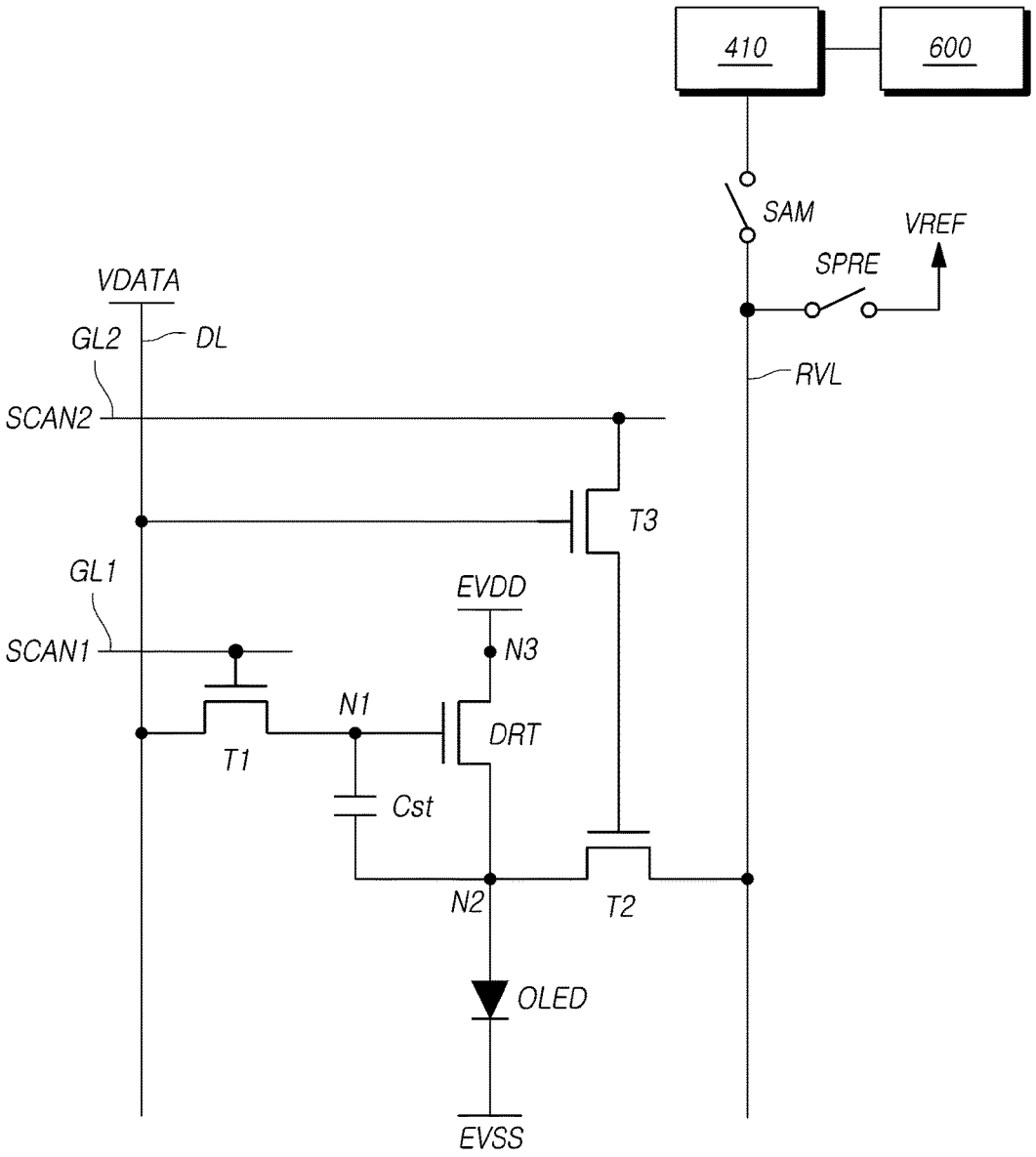
FIG. 6 is a diagram illustrating an organic light emitting diode short circuit detection circuit according to an embodiment of the invention.

FIG. 6 is a diagram illustrating an organic light emitting diode short circuit detection circuit according to embodiments.

Referring to FIG. 6, the organic light emitting diode short circuit detection circuit according to embodiments includes the subpixel SP having a subpixel structure that enables detection of an organic light emitting diode short circuit, the sensing unit 410 that senses a voltage of the reference voltage line RVL, and a detection unit 600 that determines whether or not an organic light emitting diode short circuit occurs using a sensing result of the sensing unit 410.

Referring to FIG. 6, each subpixel SP has a subpixel structure that enables detection of an organic light emitting diode short circuit.

Each subpixel SP includes the organic light emitting diode OLED, the driving transistor DRT, the first transistor T1, the second transistor T2, the third transistor T3, the storage capacitor Cst, etc.

That is, each subpixel has a 4T1C structure including the four transistors DRT, T1, T2, and T3 and the single capacitor Cst.

The organic light emitting diode OLED includes the first electrode E1, the organic emission layer EL, and the second electrode E2.

The driving transistor DRT includes the first node N1 corresponding to a gate node, the second node N2 electrically connected to the first electrode E1 of the organic light emitting diode OLED, and the third node N3 to be applied with the driving voltage EVDD.

The first node N1 can be a gate node, the second node N2 may be a source node or a drain node, and the third node N3 can be a drain node or a source node.

The first transistor T1 can be electrically connected between the first node N1 of the driving transistor DRT and the data line DL.

An on or off operation of the first transistor T1 is controlled by the first scan signal SCAN1 applied to a gate node of the first transistor T1 through a first scan line GL1.

The second transistor T2 can be electrically connected between the second node N2 of the driving transistor DRT and the reference voltage line RVL.

The second transistor T2 is controlled by the second scan signal SCAN2 applied to a gate node of the second transistor T2.

The third transistor T3 is a transistor capable of controlling whether or not to apply the second scan signal SCAN2 to the gate node of the second transistor T2 and controls an on or off operation of the second transistor T2.

The third transistor T3 can be electrically connected between the gate node of the second transistor T2 and a second scan line GL2 that supplies the second scan signal SCAN2.

An on or off operation of the third transistor T3 is controlled by the data voltage VDATA applied to a gate node.

If the third transistor T3 is turned on by the data voltage VDATA, the second scan signal SCAN2 is applied to the gate node of the second transistor T2.

In this instance, if the second scan signal SCAN2 is a turn-on level voltage (e.g., HIGH), the second transistor T2 can be turned on.

The storage capacitor Cst can be electrically connected between the first node N1 and the second node N2 of the driving transistor DRT.

Referring to FIG. 6, the gate node of the third transistor T3 can be connected to the data line DL electrically connected to the drain node or the source node of the first transistor T1 in the same subpixel.

According to the above-described subpixel structure, an on or off operation of the second transistor T2 that electrically connects the first electrode E1 of the organic light emitting diode OLED to the reference voltage line RVL is controlled using the data voltage VDATA which can be supplied differentially for each subpixel in a single row. Thus, subpixels can be driven to accurately detect an organic light emitting diode short circuit from each subpixel unit.

Referring to FIG. 6, the organic light emitting diode short circuit detection circuit according to embodiments can further include the sensing unit 410 and the detection unit 600 in addition to the subpixel having a 4T1C structure.

When the sensing unit 410 is electrically connected to the reference voltage line RVL through the sampling switch SAM, the sensing unit 410 can sense a voltage of the reference voltage line RVL and output a sensing value corresponding to a sensing voltage VSEN.

If the sensing unit 410 is implemented as an analog to digital converter, the sensing unit 410 can convert the sensing voltage VSEN of the reference voltage line RVL into a sensing value corresponding to a digital value and then output the sensing value.

The detection unit 600 can detect whether or not the organic light emitting diode OLED is short-circuited based on a sensing value output by the sensing unit 410 or a sensing value output by the sensing unit 410 and then stored in the memory 420.

According to the above description, it is possible to perform a sensing process and a detection process capable of accurately detecting an organic light emitting diode short circuit from each individual subpixel unit (e.g., each subpixel can be sensed individually, even when sharing a same reference voltage line (RVL)).

Figure 7:
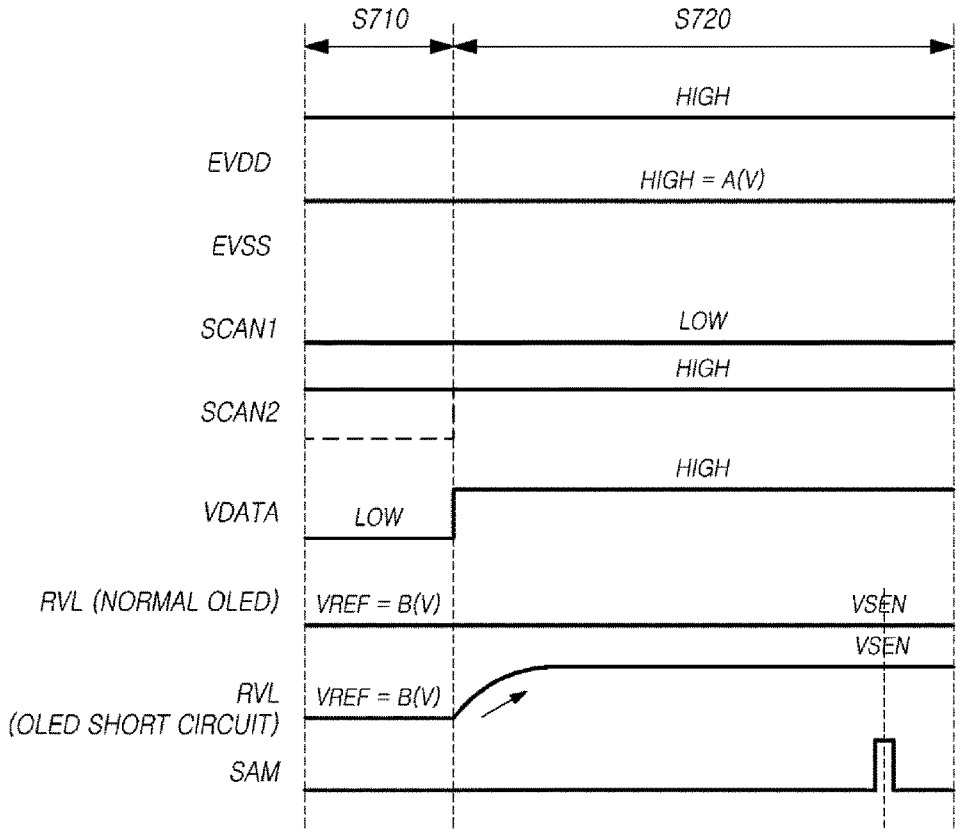
FIG. 7 is a timing chart of detection of an organic light emitting diode short circuit according to an embodiment of the invention.

FIG. 7 is a timing chart of detection of an organic light emitting diode short circuit according to embodiments.

Referring to FIG. 7, a method of detecting an organic light emitting diode short circuit according to the embodiments can be performed during an initialization period S710 and a detection period S720.

The initialization period S710 is a period in which a subpixel state is initialized before actual driving for detection of an organic light emitting diode short circuit.

The detection period S720 is a period in which actual driving for detection of an organic light emitting diode short circuit is performed.

Referring to FIG. 7, in the periods S710 to S720 for detection of a short circuit of the organic light emitting diode OLED in a first subpixel selected to check whether an organic light emitting diode short circuit occurs from among a plurality of subpixels SP, the first transistor T1 and the driving transistor DRT of the first subpixel SP are turned off during the initialization period S710.

That is, during the initialization period S710, the first scan signal SCAN1 can be a turn-off level voltage LOW.

Also, during the initialization period S710, the second transistor T2 is not turned on.

Thus, regardless of on or off of the third transistor T3 (e.g., regardless of a level of the data voltage VDATA), the second scan signal SCAN2 can be set to the turn-off level voltage LOW to turn off the second transistor T2.

Alternatively, the data voltage VDATA can be set to the turn-off level voltage LOW to turn off the third transistor T3 and thus turn off the second transistor T2.

During the initialization period S710, the reference voltage line RVL can be initialized to a reference voltage for detection VREF.

Herein, the reference voltage for detection VREF can be set to a voltage value of B(V).

During the initialization period S710, the second electrode E2 of the organic light emitting diode OLED in the first subpixel SP is initialized to a ground voltage for detection EVSS.

Herein, the ground voltage for detection EVSS can be set to a voltage value of A(V).

As described above, during the initialization period S710, in order to turn off the second transistor T2 in a state where the reference voltage line RVL is initialized to the reference voltage for detection VREF and the second electrode E2 of the organic light emitting diode OLED in the first subpixel SP is initialized to the ground voltage for detection, the data voltage VDATA applied to the gate node of the third transistor T3 of the first subpixel SP can be set to the turn-off level voltage LOW or the second scan signal SCAN2 can be set to the turn-off level voltage LOW. Thus, it is possible to suppress the spread of a voltage state of the first electrode E1 of the organic light emitting diode OLED to the reference voltage line RVL.

That is, even if the organic light emitting diode OLED is short-circuited, the reference voltage line RVL can be accurately initialized to the reference voltage for detection VREF without being affected by the organic light emitting diode short circuit. Thus, detection of an organic light emitting diode short circuit can be performed more accurately.

In addition, during the initialization period S710, the driving voltage EVDD can be used as a high voltage HIGH (e.g., about 26 V) used for display driving or can be set to a low voltage LOW to not operate the driving transistor DRT.

Referring to FIG. 7, in the periods S710 to S720 for detection of a short circuit of the organic light emitting diode OLED in the first subpixel selected to check whether an organic light emitting diode short circuit occurs from among the plurality of subpixels SP, when the second transistor T2 is turned on while the initialization period S710 proceeds, the detection period S720 is started.

During the detection period S720 which proceeds before the sampling switch SAM is turned on, the first transistor T1 and the driving transistor DRT of the first subpixel SP are in an off state and the second transistor T2 and the third transistor T3 is in an on state.

That is, the first scan signal SCAN1 applied to the gate node of the first transistor T1 in the first subpixel SP is the turn-off level voltage LOW.

Therefore, the first transistor T1 is in an off state, and the driving transistor DRT is also in an off state since the data voltage VDATA is not applied to the gate node of the driving transistor DRT.

The data voltage VDATA applied to the gate node of the third transistor T3 in the first subpixel SP, which is a turn-on level voltage HIGH.

When the third transistor T3 of the first subpixel SP is turned on, the second scan signal SCAN2 of the turn-on level voltage HIGH can be applied to the gate node of the second transistor T2.

After the detection is performed for a period of time as described above, the sampling switch SAM is turned on to connect the sensing unit 410 to the reference voltage line RVL.

Thus, the sensing unit 410 senses a voltage of the reference voltage line RVL.

According to the above description, in a state where the first transistor T1 and the driving transistor DRT of the first subpixel SP are turned off and the second transistor T2 and the third transistor T3 are turned on, the sensing unit 410 can sense a voltage of the second node N2 of the driving transistor DRT electrically connected to the first electrode E1 of the organic light emitting diode OLED through the reference voltage line RVL. Thus, it is possible to accurately detect an organic light emitting diode short circuit to the exclusion of the effects of the first transistor T1 and the driving transistor DRT.

During the detection period S720, the driving voltage EVDD can be used as a high voltage HIGH, which is used for display driving or can be set to a low voltage to not operate the driving transistor DRT.

Referring to FIG. 7, the voltage value (A(V)) of the ground voltage for detection EVSS applied to the second electrode E2 of the organic light emitting diode OLED can be different from the voltage value (B(V)) of the reference voltage for detection VREF applied to the reference voltage line RVL during the initialization period S710.

As an example, the voltage value (A(V)) (e.g., 6.5 (V)) of the ground voltage for detection EVSS can be greater than the voltage value (B(V)) (0 (V)) of the reference voltage for detection VREF. For example, FIG. 7 corresponds to this situation.

As another example, the voltage value (A(V)) of the ground voltage for detection EVSS can be less than the voltage value (B(V)) of the reference voltage for detection VREF.

Also, the voltage value (A(V)) (e.g., 6.5 (V)) of the ground voltage for detection EVSS greater than the voltage value (e.g., 0 (V)) of the ground voltage during an image display period.

As described above, since the ground voltage for detection EVSS is set to a voltage value different from the reference voltage for detection VREF for the initialization period S710, when the second transistor T2 is turned on, a voltage of the reference voltage line RVL can be changed if there is a short circuit of the organic light emitting diode OLED (e.g., if no short circuit, then voltage of RVL should stay the same). Such a change in voltage makes it possible to easily and accurately determine whether or not an organic light emitting diode short circuit occurs.

Referring to FIG. 7, the detection unit 600 can compare the sensing voltage VSEN with the reference voltage for detection VREF based on the sensing value obtained by the sensing unit 410 and detect whether or not the organic light emitting diode OLED of the first subpixel SP is short-circuited.

Accordingly, it is possible to easily, rapidly and accurately determine whether or not an organic light emitting diode short circuit occurs simply by comparing the sensing voltage VSEN obtained via sensing driving with the reference voltage for detection VREF already known.

The method of detection via comparison will be described in more detail with reference to FIG. 7.

The voltage value (A(V)) (e.g., 6.5 (V)) of the ground voltage for detection EVSS can be set to be higher than the voltage value (B(V)) (0 (V)) of the reference voltage for detection VREF. In this instance, assuming that the organic light emitting diode OLED is not short-circuited, even if the second transistor T2 is turned on to electrically connect the first electrode E1 of the organic light emitting diode OLED to the reference voltage line RVL, the reference voltage line RVL should maintain the reference voltage for detection VREF applied during the initialization period S710, or at least, the reference voltage line RVL should not experience a great change in voltage.

Therefore, if the sensing voltage VSEN is equal to the reference voltage for detection VREF or changed by a predetermined amount of change or less based on the reference voltage for detection VREF as a result of comparison in voltage, the detection unit 600 can determine that a short circuit does not occur in the organic light emitting diode OLED of the first subpixel SP.

The voltage value (A(V)) (e.g., 6.5 (V)) of the ground voltage for detection EVSS can be set to be higher than the voltage value (B(V)) (0 (V)) of the reference voltage for detection VREF. In this instance, assuming that the organic light emitting diode OLED is short-circuited, the first electrode E1 of the organic light emitting diode OLED is changed to correspond to the ground voltage for detection EVSS of the second electrode E2.

Therefore, if the second transistor T2 is turned on to electrically connect the first electrode E1 of the organic light emitting diode OLED to the reference voltage line RVL, the reference voltage line RVL cannot maintain the reference voltage for detection VREF applied during the initialization period S710 but can be changed to correspond to a voltage state of the first electrode E1 of the organic light emitting diode OLED.

Therefore, if the sensing voltage VSEN is higher than the reference voltage for detection VREF or changed by more than the predetermined amount of change based on the reference voltage for detection VREF, the detection unit 600 can determine that a short circuit occurs in the organic light emitting diode OLED of the first subpixel SP.

Accordingly, simply by comparing the sensing voltage VSEN obtained via sensing driving with the reference voltage for detection VREF already known, it is possible to accurately determine that a short circuit occurs in the organic light emitting diode OLED if a difference (voltage variation) between the sensing voltage VSEN and the reference voltage for detection VREF is higher than a predetermined level (predetermined amount of change) as a result of comparison.

The above-described detection unit 600 can store information (e.g., subpixel identification information and subpixel position information) about the subpixel SP in which an organic light emitting diode short circuit is detected in the memory or can output the information on a screen or the like.

Thus, it is possible to easily identify a position for a repair process for the subpixel. Herein, the repair process can be, for example, a laser cutting process of electrically cutting the first electrode E1 of the short-circuited organic light emitting diode OLED and the second node N2 of the driving transistor DRT. Alternatively, the repair process can be a process of suppressing application of the ground voltage EVSS to the second electrode E2 of the organic light emitting diode OLED.

Figure 8:
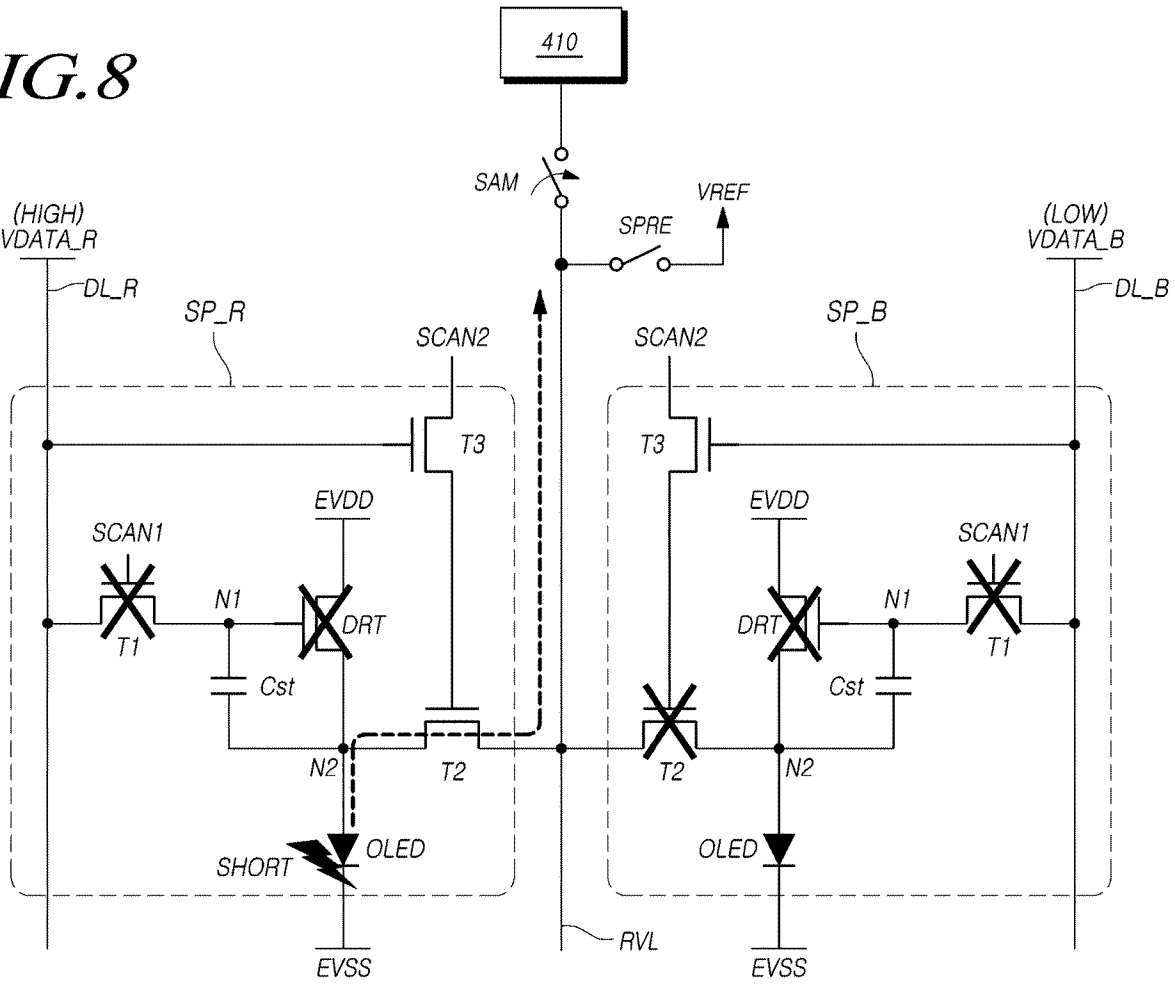
FIG. 8 is a diagram illustrating an organic light emitting diode short circuit detection circuit in a sensing sharing structure of the organic light emitting display device according to an embodiment of the invention.
Figure 9:
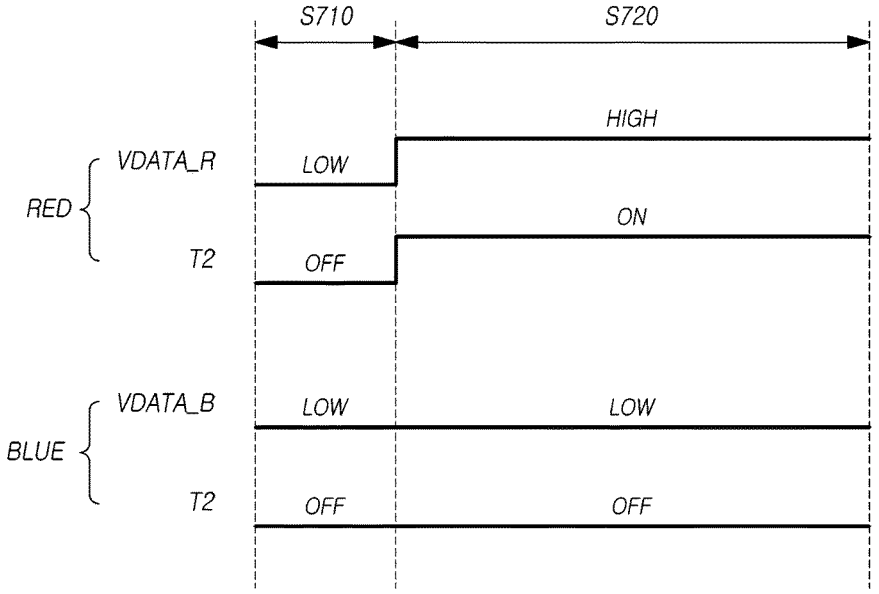
FIG. 9 is a diagram illustrating the principle of detecting an organic light emitting diode short circuit from each subpixel unit in the organic light emitting display device according to an embodiment of the invention.

FIG. 8 is a diagram illustrating an organic light emitting diode short circuit detection circuit in a sensing sharing structure of the organic light emitting display device 100 according to embodiments, and FIG. 9 is a diagram provided to explain the principle of detecting an organic light emitting diode short circuit from each subpixel (SP) unit in the organic light emitting display device 100 according to embodiments.

Referring to FIG. 8, two subpixels SP_R and SP_B share a single reference voltage line RVL.

That is, the reference voltage line RVL electrically connected to the drain node or the source node of the second transistor T2 of a first subpixel SP_R can also be electrically connected to the drain node or the source node of the second transistor T2 of a second subpixel SP_B adjacent to the first subpixel SP_R.

According to the above-described sensing sharing structure, fewer reference voltage lines RVL can be used in the organic light emitting display panel 110, and, thus, a panel aperture ratio can be increased and the number of switches SAM and SPRE and sensing units 410 connected to the reference voltage line RVL can be reduced. Therefore, if the switches SAM and SPRE and the sensing unit 410 are included in the source driver integrated circuit SDIC, the source driver integrated circuit SDIC designed can be simplified and reduced in size.

In the sensing sharing structure described above, the organic light emitting diode short circuit detection circuit according to embodiments can distinguish and detect a short circuit of the organic light emitting diode OLED in each of the two subpixels SP_R and SP_B.

This is because an on or off operation of the second transistor T2 can be controlled by the data voltage VDATA specific to each individual subpixel.

That is, if a subpixel selected to check whether an organic light emitting diode short circuit occurs is the first subpixel SP_R, a data voltage VDATA_R of a turn-on level voltage HIGH is supplied to the first subpixel SP_R to turn on the third transistor T3. Thus, the second transistor T2 is turned on. Therefore, a voltage state of the reference voltage line RVL can be changed depending on whether or not a short circuit occurs in the organic light emitting diode OLED in the first subpixel SP_R.

In this instance, a data voltage VDATA_B of a turn-off level voltage LOW is supplied to the second subpixel SP_B to turn off the third transistor T3. Thus, the second transistor T2 is turned off. Therefore, the voltage state of the reference voltage line RVL cannot be affected depending on whether or not a short circuit occurs in the organic light emitting diode OLED in the second subpixel SP_B.

In other words, as illustrated in FIG. 9, during the detection period S720 for detection of a short circuit in the organic light emitting diode OLED in the first subpixel SP_R, the data voltage VDATA_R applied to the gate node of the third transistor T3 of the first subpixel SP is a turn-on level voltage HIGH, and in a state where the second transistor T2 of the first subpixel SP is turned on, the data voltage VDATA_B applied to the gate node of the third transistor T3 of the second subpixel SP_B which shares the reference voltage line RVL with the first subpixel SP_R is a turn-off level voltage LOW and the second transistor T2 of the second subpixel SP is in an off state.

Therefore, in case of detecting whether or not an organic light emitting diode short circuit occurs from the first subpixel SP_R, it is possible to accurately perform detection without the effects of the other subpixel SP_B sharing the reference voltage line RVL.

A method for driving the above-described organic light emitting display device 100 for detection of an organic light emitting diode short circuit will be briefly described again.

Figure 10:
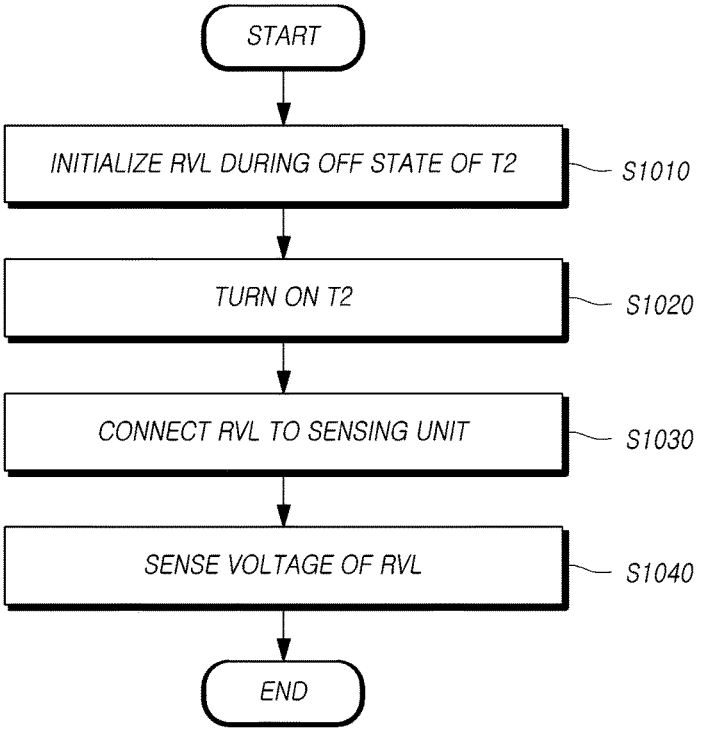
FIG. 10 is a flow chart of a method for driving the organic light emitting display device according to an embodiment of the invention.

FIG. 10 is a flow chart for a method of driving the organic light emitting display device 100 according to embodiments.

Referring to FIG. 10, embodiments can provide a method for driving the organic light emitting display device 100 including the organic light emitting display panel 110 in which the plurality of data lines DL and the plurality of scan lines GL are disposed and the plurality of subpixels SP defined by the plurality of data lines DL and the plurality of scan lines GL is disposed, and the organic light emitting diode OLED, the driving transistor DRT that drives the organic light emitting diode OLED, and the first transistor T1 electrically connected between the gate node of the driving transistor DRT and the data line DL are disposed in each subpixel SP.

The driving method can include initializing the reference voltage line RVL to the reference voltage for detection VREF in a state where the second transistor T2 connected between the first electrode E1 of the organic light emitting diode OLED and the reference voltage line RVL is turned off (S1010), turning on the second transistor T2 (S1020), connecting the sensing unit 410 to the reference voltage line RVL when a predetermined time passes after the second transistor T2 is turned on (S1030), and sensing a voltage of the reference voltage line RVL by the sensing unit 410 (S1040).

The above-described step S1010 is included in the initialization period S710.

The above-described steps S1020, S1030, and S1040 are included in the detection period S720.

According to the above-described driving method, it is possible to accurately detect whether or not an organic light emitting diode short circuit occurs.

The gate node of the second transistor T2 can be electrically connected to the data line DL electrically connected to the drain node or the source node of the first transistor T1.

Therefore, the second transistor T2 can be turned on or turned off depending on a voltage level (turn-on voltage level, turn-off voltage level) of the data voltage VDATA on the data line DL.

As such, since the gate node of the second transistor T2 is connected to the data line DL, an on or off operation of the second transistor T2 that connects the first electrode E1 of the organic light emitting diode OLED to the reference voltage line RVL can be controlled by the data voltage VDATA supplied for each subpixel. Thus, it is possible to accurately detect whether or not an organic light emitting diode short circuit occurs in each subpixel unit.

The above-described turn-on level voltage can be a high-level voltage HIGH or a low-level voltage LOW depending on transistor type. The turn-off level voltage can be a low-level voltage LOW or a high-level voltage HIGH depending on transistor type.

In the present specification and drawings, the turn-on level voltage is described as a high-level voltage HIGH and the turn-off level voltage is described as a low-level voltage LOW for convenience in explanation.

Further, each transistor can have a different turn-on level voltage HIGH, and each transistor can have a different turn-off level voltage LOW.

According to the embodiments described above, it is possible to provide the organic light emitting display panel 110 having a subpixel structure which can detect a short circuit between an anode electrode and a cathode electrode of the organic light emitting diode OLED, the organic light emitting display device 100, and a method for driving the same.

Further, according to the embodiments described above, it is possible to provide the organic light emitting display panel 110 having a subpixel structure in which two or more subpixels share a single sensing line (e.g., reference voltage line RVL) and which can accurately distinguish and detect a short circuit of an organic light emitting diode in each subpixel unit, the organic light emitting display device 100, and a method for driving the same.

The foregoing description and the accompanying drawings are provided only to illustrate the technical conception of the present invention, but it will be understood by a person having ordinary skill in the art that various modifications and changes such as combinations, separations, substitutions, and alterations of the components may be made without departing from the scope of the present invention. Therefore, the exemplary embodiments of the present invention are provided for illustrative purposes only but not intended to limit the technical concept of the present invention. The scope of the technical concept of the present invention is not limited thereto. Therefore, it should be understood that the above-described exemplary embodiments are illustrative in all aspects and do not limit the present invention. The protective scope of the present invention should be construed based on the following claims, and all the technical concepts in the equivalent scope thereof should be construed as falling within the scope of the present invention.

What is claimed is:

1. An organic light emitting display device comprising:

an organic light emitting display panel including a plurality of data lines, a plurality of scan lines, and a plurality of subpixels defined by the plurality of data lines and the plurality of scan lines;

a data driver configured to drive the plurality of data lines; and a scan driver configured to drive the plurality of scan lines, wherein each of the plurality of subpixels includes:

an organic light emitting diode including a first electrode, an organic emission layer, and a second electrode;

a driving transistor including a first node corresponding to a driving gate node, a second node electrically connected to the first electrode of the organic light emitting diode, and a third node to be applied with a driving voltage;

a first transistor controlled by a first scan signal applied to a first gate node and electrically connected between the first node of the driving transistor and a data line among the plurality of data lines;

a second transistor controlled by a second scan signal applied to a second gate node and electrically connected between the second node of the driving transistor and a reference voltage line;

a third transistor controlled by a data voltage applied to a third gate node and electrically connected between the second gate node of the second transistor and a second scan line; and a storage capacitor electrically connected between the first node and the second node of the driving transistor.

2. The organic light emitting display device according to claim 1, wherein the third gate node of the third transistor is connected to the data line electrically connected to a drain node or a source node of the first transistor.

3. The organic light emitting display device according to claim 1, further comprising:

a sensing unit configured to sense a voltage of the reference voltage line when electrically connected to the reference voltage line through a sampling switch and output a sensing value corresponding to a sensing voltage; and a detection unit configured to detect whether or not the organic light emitting diode is short-circuited based on the sensing value.

4. The organic light emitting display device according to claim 3, wherein during a short circuit detection period for detecting a short circuit in the organic light emitting diode in a first subpixel among the plurality of subpixels before the sampling switch is turned on, a first scan signal of a turn-off level voltage is applied to the first gate node of the first transistor of the first subpixel, a data voltage of a turn-on level voltage is applied to the third gate node of the third transistor of the first subpixel, and when the third transistor of the first subpixel is turned on, a second scan signal of a turn-on level voltage is applied to the second gate node of the second transistor of the first subpixel.

5. The organic light emitting display device according to claim 4, wherein an initialization period proceeds before the short circuit detection period, and during the initialization period, the reference voltage line is initialized to a reference voltage, a second electrode of the organic light emitting diode of the first subpixel is initialized to a ground voltage for short circuit detection, and at least one of the third gate node of the third transistor of the first subpixel is applied with a turn-off level voltage and the second scan signal is a turn-off level voltage for turning off the second transistor of the first subpixel.

6. The organic light emitting display device according to claim 5, wherein the ground voltage for the short circuit detection has a different voltage value than the reference voltage for the short circuit detection, and wherein the ground voltage for the short circuit detection is greater than a ground voltage for an image display period.

7. The organic light emitting display device according to claim 5, wherein the detection unit detects whether or not the organic light emitting diode of the first subpixel is short-circuited based on a comparison between the reference voltage and the sensing value or the sensing voltage.

8. The organic light emitting display device according to claim 5, wherein the detection unit determines that the organic light emitting diode of the first subpixel is not short circuited when the sensing voltage is equal to the reference voltage or when the sensing voltage changes less than a predetermined amount of change during the short circuit detection period, and wherein the detection unit determines that the organic light emitting diode of the first subpixel is short circuited when the sensing voltage is greater than the reference voltage or when the sensing voltage changes by more than the predetermined amount during the short circuit detection period.

9. The organic light emitting display device according to claim 4, wherein the reference voltage line electrically connected to a drain node or a source node of the second transistor of the first subpixel is also electrically connected to a drain node or a source node of a second transistor of a second subpixel among the plurality of subpixels, and wherein the second subpixel is adjacent to the first subpixel.

10. The organic light emitting display device according to claim 9, wherein during the short circuit detection period for the first subpixel, when the data voltage applied to the third gate node of the third transistor of the first subpixel is a turn-on level voltage and the second transistor of the first subpixel is in an on state, a data voltage applied to the third gate node of the third transistor of the second subpixel sharing the reference voltage line with the first subpixel is a turn-off level voltage and the second transistor of the second subpixel is in an off state.

11. The organic light emitting display device according to claim 1, wherein at least three subpixels in a pixel unit among the plurality of subpixels are connected to the reference voltage line.

12. An organic light emitting display panel comprising:

a plurality of data lines;

a plurality of scan lines; and a plurality of subpixels defined by the plurality of data lines and the plurality of scan lines, wherein each of the plurality of subpixels includes:

an organic light emitting diode including a first electrode, an organic emission layer, and a second electrode;

a driving transistor including a first node corresponding to a driving gate node, a second node electrically connected to the first electrode of the organic light emitting diode, and a third node to be applied with a driving voltage;

a first transistor controlled by a first scan signal applied to a first gate node of the first transistor and electrically connected between the first node of the driving transistor and a data line among the plurality of data lines;

a second transistor controlled by a second scan signal applied to a second gate node of the second transistor and electrically connected between the second node of the driving transistor and a reference voltage line;

a third transistor controlled by a data voltage applied to a third gate node of the third transistor and electrically connected between the second gate node of the second transistor and a second scan line configured to supply the second scan signal; and a storage capacitor electrically connected between the first node and the second node of the driving transistor.

13. The organic light emitting display panel according to claim 12, wherein the third gate node of the third transistor and a drain node or a source node of the first transistor are both connected to the data line.

14. The organic light emitting display panel according to claim 12, wherein at least three subpixels in a pixel unit among the plurality of subpixels are connected to the reference voltage line.

15. The organic light emitting display panel according to claim 12, wherein a red subpixel, a white subpixel, a green subpixel and a blue subpixel in a pixel unit among the plurality of subpixels are connected to the reference voltage line.

16. A method for detecting a short circuit in an organic light emitting diode in an organic light emitting display panel, the method comprising:

initializing a reference voltage line connected to a first subpixel and a second subpixel to a reference voltage;

turning on a second transistor connected between the reference voltage line and a driving transistor within the first subpixel;

connecting a sensing unit to the reference voltage line, via a sampling switch, when a predetermined time elapses after the second transistor is turned on;

sensing a sensing voltage of the reference voltage line by the sensing unit; and determining whether or not an organic light emitting diode in the first subpixel is short circuited based on comparing the sensing voltage and the reference voltage.

17. The method of claim 16, further comprising:

turning on and off the second transistor within the first subpixel based on a data voltage supplied to a data line electrically connected to a drain node or a source node of a first transistor within the first subpixel, wherein the first transistor within the first subpixel is connected to a driving gate node of a driving transistor connected to the organic light emitting diode in the first subpixel.

18. The method of claim 16, further comprising:

determining whether or not an organic light emitting diode in the second subpixel is short circuited based on comparing the sensing voltage and the reference voltage.

19. The method of claim 16, wherein at least three subpixels in a pixel unit among a plurality of subpixels in the organic light emitting display panel are connected to the reference voltage line.

* * * * *